US008066360B2

(12) United States Patent
Myers et al.

(10) Patent No.: US 8,066,360 B2
(45) Date of Patent: Nov. 29, 2011

(54) FLUID CARTRIDGE FOR A FLUID SUPPLY SYSTEM

(75) Inventors: John A. Myers, Corvallis, OR (US); Curt Gene Gonzales, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1137 days.

(21) Appl. No.: 11/736,750

(22) Filed: Apr. 18, 2007

(65) Prior Publication Data

US 2008/0259141 A1 Oct. 23, 2008

(51) Int. Cl.
*B41J 2/175* (2006.01)

(52) U.S. Cl. ..... 347/86

(58) Field of Classification Search ..... None
See application file for complete search history.

(56) References Cited

U.S. PATENT DOCUMENTS 6,206,514 B1 * 3/2001 Tajima et al. ..... 347/86
6,293,665 B1 9/2001 Pew et al.
6,644,796 B2 * 11/2003 Olsen ..... 347/93
2002/0012033 A1 1/2002 Iwanaga et al.
2002/0071012 A1 6/2002 Breemes
2003/0038866 A1 2/2003 Yu
2005/0270341 A1 12/2005 Yamamoto
2005/0270347 A1 12/2005 Yamamoto

FOREIGN PATENT DOCUMENTS

EP 0739741 7/2003

OTHER PUBLICATIONS

U.S. Appl. No. 10/975,261, filed Oct. 27, 2004, Myers et al.
Please see attached International Search Report for International Application No. PCT/US2008/060348. Filing date: Apr. 15, 2008.

* cited by examiner

*Primary Examiner* — Uyen Chau N Le
*Assistant Examiner* — Hoang Tran

(57) ABSTRACT

A fluid cartridge for a printing device includes a housing having a base and a first and second chamber. A wall extends outwardly from and substantially normal to the base and is configured to separate the housing, thereby forming the first and second chambers. An air/ink exchange port is defined in a bottom portion of the wall and adjacent to the base. A longitudinal air flow-restricting member is disposed adjacent the air/ink exchange port and on the base, and extends outwardly predetermined distance into one of the first or second chambers.

18 Claims, 4 Drawing Sheets

FLUID CARTRIDGE FOR A FLUID SUPPLY SYSTEM

BACKGROUND

The present disclosure relates generally to fluid cartridges, and more particularly, to a fluid cartridge for a fluid supply system.

Inkjet printers often use replaceable fluid cartridges to supply ink and/or other fluids to a printing device to form an image on print media. Some fluid cartridges include two or more internal chambers configured to hold the ink, where the chambers are often separated by a wall having an air/ink exchange port formed therein. The air/ink exchange port provides air and/or ink communication between the chambers. The ink is selectively taken from one or more of the chambers and delivered to and ejected through nozzles of a printhead and then onto the print media. In some instances, however, fluid may continue to flow through the printhead even when the printhead is not actuated by the printer.

To prevent the free flow of ink during non-use of the printhead, a negative or back pressure is formed in the ink within the cartridge that overcomes the pressure at the printhead when the printhead is not in use. Thus, a vacuum is formed in the free ink chamber of the cartridge and holds the ink therein. The back pressure within the free ink chamber of the cartridge is generally maintained by capillary force and the flow of air and/or ink back and forth through the air/ink exchange port. Difficulties may arise, however, in maintaining the back pressure in the cartridge when additional, unintended air enters the air/ink exchange port from various leak regions that may form during construction of the fluid cartridge.

Further difficulties may arise from a lack of desirable back pressure. For example, if one cartridge fails to provide sufficient back pressure, the ink may drool out the nozzles onto the orifice plate, and then may be drawn up by back pressure of another color cartridge. This may result in undesirable color mixing.

DESCRIPTION OF THE DRAWINGS

Features and advantages of embodiment(s) of the present disclosure will become apparent by reference to the following detailed description and the drawings, in which like reference numerals correspond to similar, though not necessarily identical components. Reference numerals having a previously described function may not necessarily be described in connection with other drawings in which they appear.

DETAILED DESCRIPTION

Embodiment(s) of the fluid cartridge for the fluid supply system as disclosed herein advantageously constrict or otherwise restrict air flow to the air/ink exchange port from various undesired air flow paths that may form in the fluid cartridge. This air flow constriction substantially maintains the back pressure level in the cartridge, thereby reducing undesirable fluid flow through the nozzle(s). This novel air flow constriction is advantageously achieved by disposing air flow-restricting members adjacent to the air/ink exchange port. Inclusion of these members in the cartridge construction may also desirably broaden the margin of error for accurately sizing and disposing ink absorbing materials into the cartridge.

Figure 1:
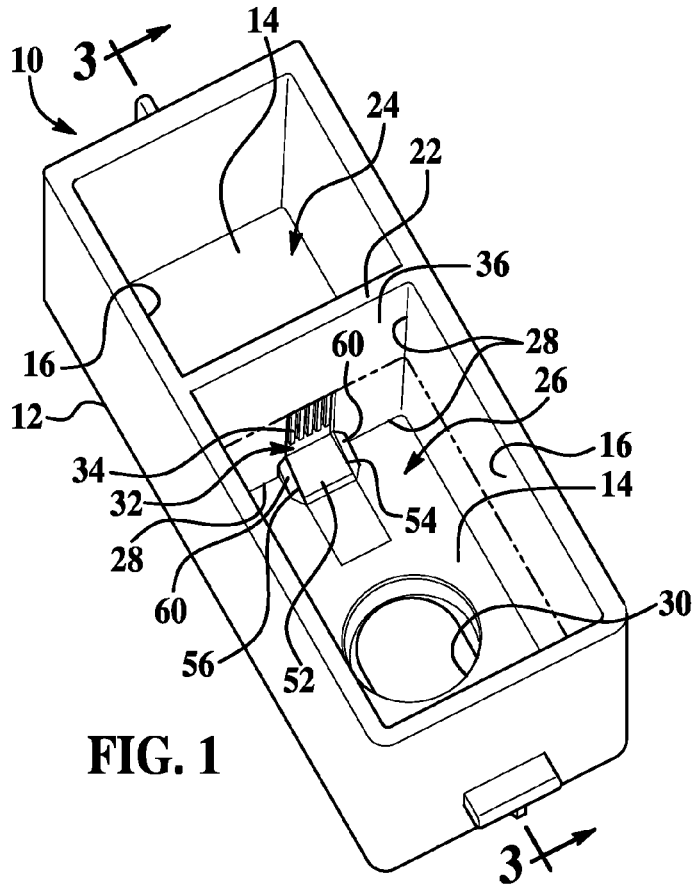
FIG. 1 is a perspective, top view of an embodiment of a fluid cartridge as disclosed herein.

With reference now to the drawings, FIG. 1 depicts a fluid cartridge 10 for an inkjet printing device (not shown). Some non-limiting examples of printing devices include thermal inkjet printers, piezoelectric inkjet printers, continuous inkjet printers, and/or combinations thereof. The fluid cartridge 10 includes a housing 12 formed by any suitable means and from any suitable material, such as for example, via integrally molding from a polymeric material. Housing 12 includes an interior space defined by a base 14 and a continuous side wall 16 extending about the periphery of the base 14. A cover 18 (shown in FIG. 3) including an air vent 20 is welded, glued, or otherwise attached to the side wall 16 to enclose the interior space of the housing 12. The housing 12 and the cover 18 may be formed of similar or dissimilar polymeric materials, which may also be opaque or transparent. Non-limiting examples of suitable polymeric materials include polypropylenes, polypropylenes alloyed with polystyrenes, polyphenylene oxide, polyurethanes, and combinations thereof.

A wall 22 is disposed within the housing 12, positioned substantially normal to the base 14 and extending outwardly from the base 14. The wall 22 also abuts opposing side walls 16, thereby forming first and second chambers 24, 26 in the housing 12. An interface or edge 28 is formed between the wall 22 and the base 14, and between the wall 22 and an adjacent opposing side wall 16.

An ink outlet or port 30 is formed in the base 14 located in the second chamber 26. The ink outlet 30 generally couples with a manifold of a printhead (not shown) including a plurality of ink nozzles. The ink outlet 30 also couples with the first and/or second chambers 24, 26, thereby providing fluid communication between the ink outlet 30 and the chambers 24, 26.

Figure 2:
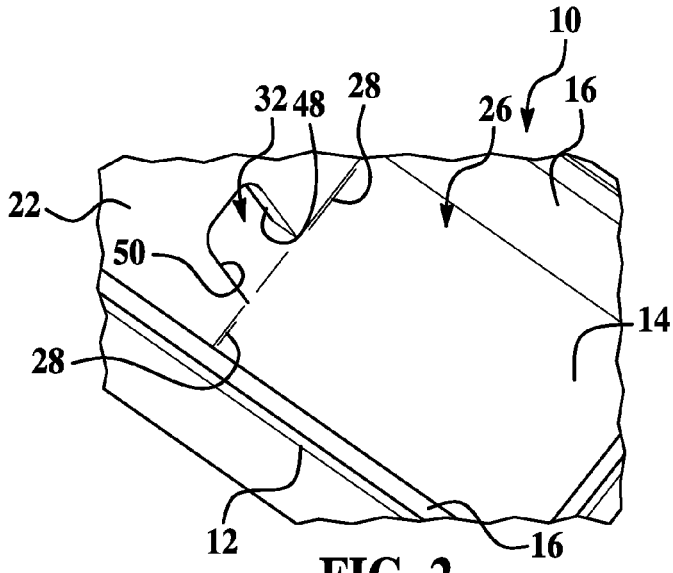
FIG. 2 is an enlarged, cutaway, perspective view of an embodiment of a fluid cartridge showing an air/ink exchange port formed therein.

With reference now to FIG. 2, the air/ink exchange port 32 is defined in the bottom portion of the wall 22 and located adjacent to the base 14. The port 32 is essentially a gap or aperture formed in the wall 22 at the interface 28, thereby exposing the wall/base interface 28. The port 32 is designed to facilitate the movement of air and the movement of ink between the first and second chambers 24, 26.

Referring now to FIG. 3, the first chamber 24 is configured to hold a volume of free flowing liquid ink and will be referred to herein as the free ink chamber (FIC) 24. For drop-on-demand printing, e.g., with thermal inkjet printers or piezoelectric inkjet printers, the capillary force of the capillary media (e.g., absorber 40, 40*a*, described below) is generally striving to pull the ink out of the FIC 24 through the air/ink exchange port 32, but it is balanced by the vacuum created in the FIC 24. When air bubbles into the FIC 24 through the air/ink exchange port 32, then ink is drawn into the media/ absorber 40, 40*a* until the vacuum in the FIC 24 is re-established. Ink from the media/absorber 40, 40*a* exits the ink outlet 30 for delivery of the ink to the printing device. As the volume of ink depletes in the free ink chamber 24, air is drawn into the cartridge 10 via the air vent 20 formed in the cover 18, and passes through the second chamber 26 and into the air/ink exchange port 32. To get to the FIC 24, it is generally desirable that the air from the vent 20 passes through de-saturated capillary media/absorbers 40, 40*a*, 40*b* and not through wrinkles and voids around the perimeter of the capillary media/absorbers 40, 40*a*, 40*b*.

In an embodiment, and as better shown in FIG. 1, a plurality of grooves 34 may be formed in a portion of the side 36 of the wall 22 facing the second chamber 26 and substantially directly above the air/ink exchange port 32 and is used to facilitate the movement of the air from the vent 20 to the port 32. The grooves 34 generally extend up the wall 22 so that, when the ink saturation level in the capillary media/absorbers 40, 40*a*, 40*b* reaches the top of the grooves 34, air can begin passing into the FIC 24, thereby allowing ink to flow into the media/absorbers 40, 40*a*, 40*b*. The air then travels into the free ink chamber 24 and through the ink such that the air lies above the ink in a top portion 38 of the chamber 24. Thus, the free ink chamber 24 generally has about the same volume of fluid (i.e., ink and air) because the volume of ink in the free ink chamber 24 is replaced by air as the ink is removed from the cartridge 10 by the printhead.

In general, when the printhead is activated, the printhead forces the ink to flow through the nozzles. When the printhead is deactivated, the printhead restricts ink flow therethrough. The nozzles are still open when the printhead is deactivated, but the pores are small enough that capillary force at the nozzles substantially prevents the cartridge from pulling air in through the nozzles. Since the nozzles are open, in some instances, they may undesirably leak ink if the cartridge 10 fails to provide desirable back pressure.

To substantially prevent the dripping and/or leaking of the ink through the nozzles, a back pressure is formed at the printhead when the printhead is deactivated, as mentioned briefly above. As used herein, the term "back pressure" refers to a partial vacuum formed within the ink in ink cartridge 10 to resist the flow of ink through the printhead. Thus, an increase in back pressure can be referred to as an increase in partial vacuum, and is measurable in terms of water column height. It is generally desirable to maintain a strong enough back pressure at the printhead to substantially prevent dripping of the ink. It should be understood, however, that the back pressure should be a suitable pressure such that the printhead overcomes the back pressure and ejects the ink when activated.

In an ideal system, the desirable back pressure level is continuously maintained in the ink cartridge 10 and at the printhead. However, changes in back pressure often may occur, for example, during changes in the ambient environment or with operation of the printhead. As the printhead ejects an ink drop, the depletion of ink from the free ink chamber 24 increases the back pressure of the chamber 24, thereby creating a larger vacuum.

Figure 3A:
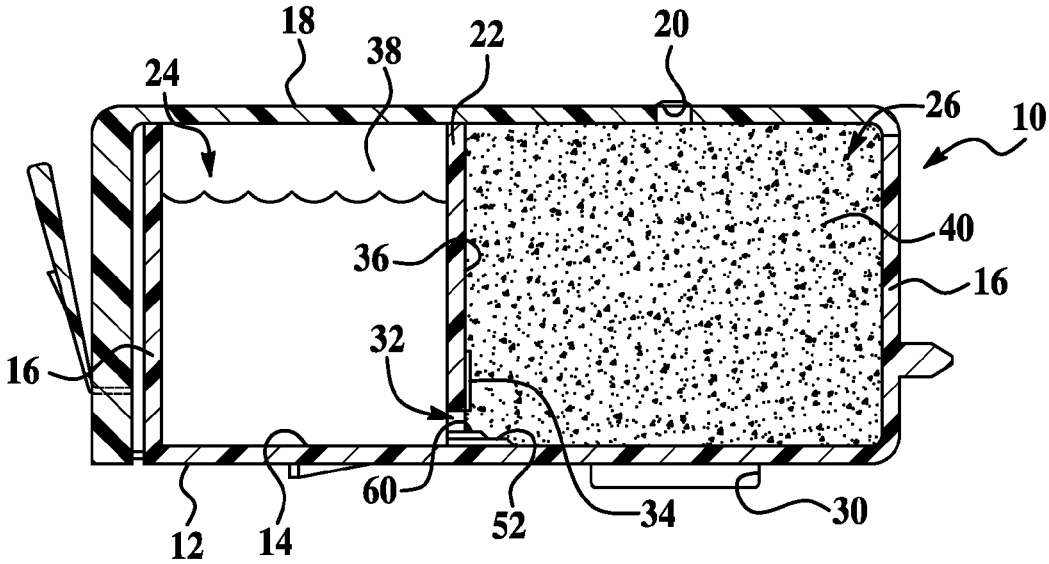
FIG. 3A is a cross-sectional side view of an embodiment of the fluid cartridge taken along line 3-3 of FIG. 1.

In an embodiment, and with reference to FIGS. 1 and 3A, the second chamber 26, also referred to herein as the absorber chamber 26, is filled with an absorber 40 configured to absorb ink from the free ink chamber 24, thereby creating the back pressure in the free ink chamber 24. The back pressure (vacuum) in the FIC 24 is alleviated by air bubbling into the FIC 24. It should be noted that the absorber 40 has been removed from FIG. 1 for the sake of clarity. The absorber 40 is a porous medium having a high capillary force effect (e.g., high capillary media) and a generally layered texture that is compressible at its edges without creating wrinkles or gaps in the porous medium. In an embodiment, the absorber 40 is selected such that it has a desired capillary force. Suitable capillary forces for absorber 40 may range from about 2" WC (water column) to about 6" WC; and in an alternate embodiment, a suitable capillary force is about 4" WC. As ink pressure increases in the free ink chamber 24, ink is transferred to the absorber 40 and held in the pores thereof. To balance the back pressure in the cartridge 10, the ink held in the pores may, in some instances, be transferred back to the free ink chamber 24. For example, if coming down from a higher elevation, or cooling down from a higher temperature, the ink will flow from the absorber 40 into the FIC 24. During events such as these, the air in the FIC 24 is contracting. During normal printing, ink will be drawn into the absorber 40, and air will be drawn into the FIC 24 by the vacuum present in the FIC 24.

Figure 3B:
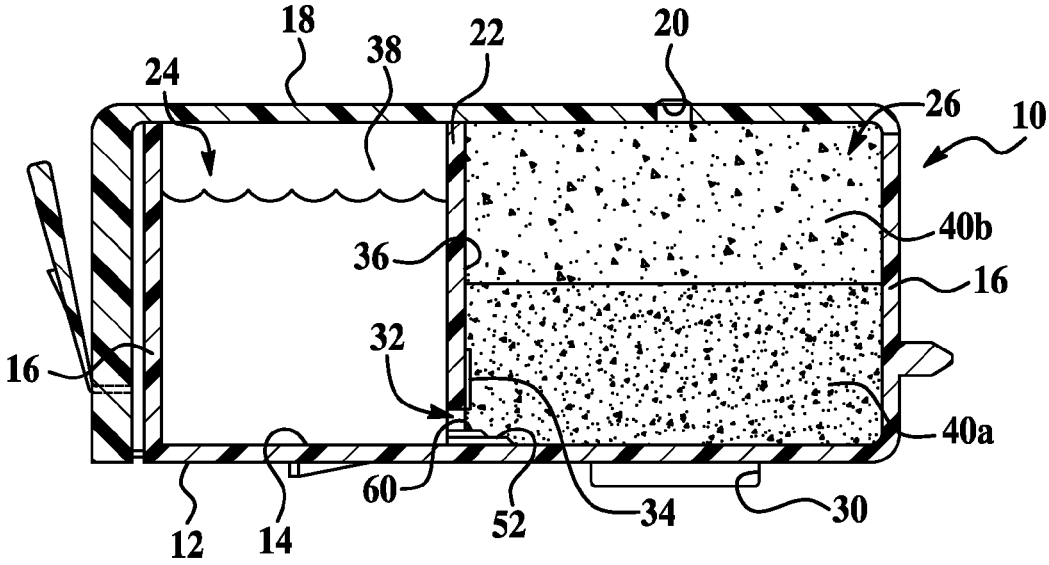
FIG. 3B is a cross-sectional side view of the fluid cartridge taken along line 3-3 of FIG. 1, depicting an alternate embodiment thereof.

In another embodiment, and with reference now to FIG. 3B, the second chamber 26 may be filled with a first absorber 40*a* disposed adjacent to a second absorber 40*b*. The first absorber 40*a* is configured similarly to the absorber 40 as shown in FIG. 3A. The second absorber 40*b* is also a porous medium, but has a low capillary force effect. In a non-limiting example, the ink first absorber 40*a* is disposed below the second absorber 40*b* and is in fluid communication therewith. In an embodiment, the second absorber 40*b* (e.g., a low capillary media (LCM)) has a capillary force of about 3" WC, and the first absorber 40*a* (e.g., a high capillary media (HCM)) has a capillary force of about 4" WC. The lower capillary force of the second absorber 40*b* generally assures that substantially all of the ink is extracted from the second absorber 40*b* prior to draining ink from the first absorber 40*a*.

Although some example capillary forces are provided above for the first absorber 40*a* and the second absorber 40*b*, it is to be understood that any suitable capillary media having a suitable capillary force may be used. Generally, the second absorber 40*b* provides sufficient back pressure to prevent drooling at the nozzles. The first absorber 40*a* should have a higher capillary force than the second absorber 40*b*. Some suitable example capillary forces for the second absorber 40*b* range from about 2" WC to about 5" WC; and for the first absorber 40*a* range from about 3" WC to about 6" WC.

Without being bound to any theory, it is believed that it is desirable for the cartridge 10 to drain substantially the entire second absorber 40*b* first, then drain a small amount of the first absorber 40*a* in order to open a bubbler path for air to reach the FIC 24, and then consistently drain substantially the entire FIC 24 before draining any additional ink from the first absorber 40*a*. One reason it is believed this method may be desirable is the low-on-ink detection system (LOID) (not shown). A sensor configured to detect when the FIC 24 empties allows the printer to know that substantially the only ink left in the cartridge 10 is in the first absorber 40*a*. This generally allows the printer to more accurately predict when printing should stop in order to prevent dry firing of the nozzles and potential damage to the printhead. However, if the first absorber 40*a* were sometimes half drained when the FIC 24 empties because of, e.g., a delayed opening of the air path through the air/ink exchange port 32 to the FIC 24; and other times the first absorber 40*a* and a portion of the second absorber 40*b* were full of ink when the FIC 24 empties, e.g., due to an unintended air path to the bubbler/air/ink exchange port 32, the LOID system may become less useful.

Figure 4:
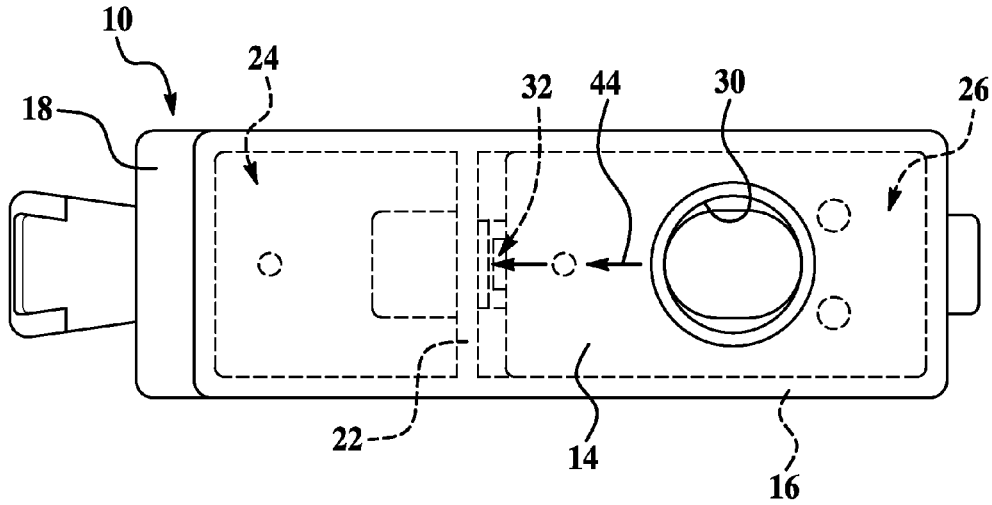
FIG. 4 is a bottom view of an embodiment of the fluid cartridge, showing a longitudinal air flow path.
Figure 5:
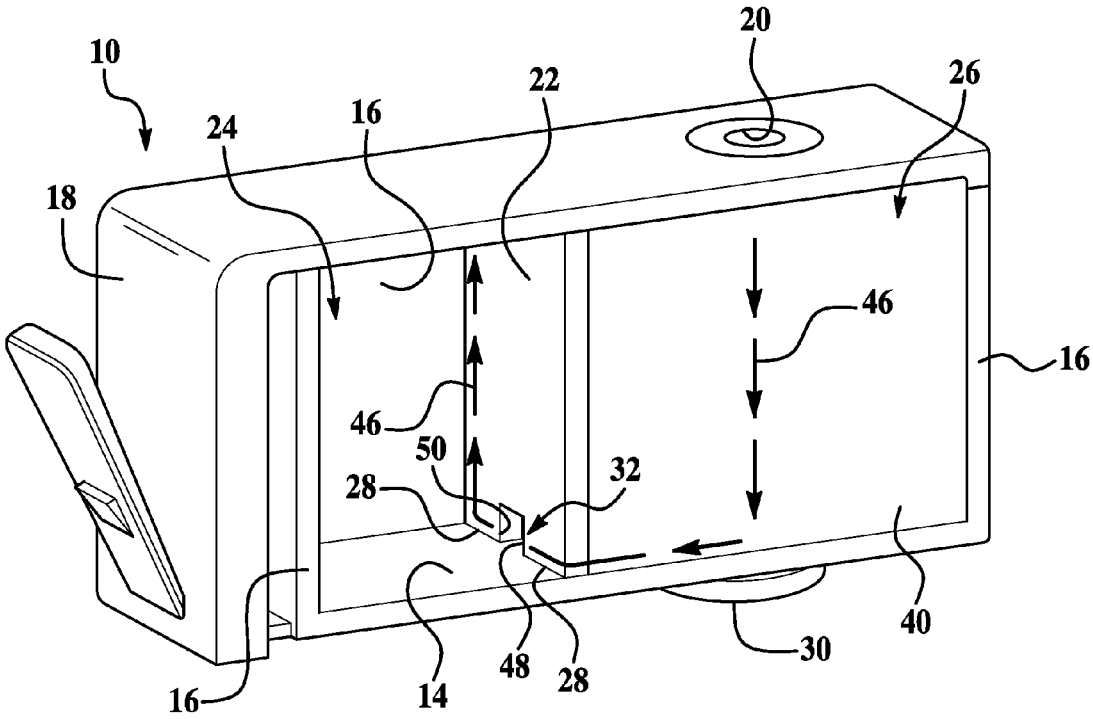
FIG. 5 is a perspective view of an embodiment of the fluid cartridge, showing transverse air flow path(s)

Since the back pressure level in the cartridge 10 may be influenced by changes in environment, operation, etc., it is generally beneficial to prevent any additional undesirable fluid, especially air, from entering the air/ink exchange port 32. As shown in FIGS. 4 and 5, potential foreign air paths 44, 46 (generally represented by arrows depicting the direction thereof) generally result from the construction of the cartridge 10. These air paths 44, 46 could penetrate the air/ink exchange port 32 and upset the back pressure level in the cartridge 10 between the chambers 24, 26. The first air path 44 (shown in FIG. 4) is a substantially longitudinal air path formed in the absorbing chamber 26 along the base 14 between the ink outlet 30 and the air/ink exchange port 32. The first air path 44 may be created when the absorber 40 is disposed within the housing 12, thereby leaving small air gaps between the absorber 40 and the base 14.

The other potential air path(s) 46 are substantially transverse air paths formed at the interface or edge 28, and travel transversely from the interface 28 to both transverse sides 48, 50 of the air/ink exchange port 32. The air path(s) 46 may be created when the wall 22 is disposed within the housing 12 but not formed integrally therewith, thereby leaving small gaps at the interface 28 that may leak into the port 32. For example, the air path(s) 46 may be formed by a wrinkle, gap or bevel in the absorber 40, 40*a* that allows air to flow along the corner between the absorber 40, 40*a* and the housing 12.

With reference again to FIG. 1, the air path 44 may be constricted or otherwise restricted by disposing a longitudinal air flow-restricting member 52 having two opposed sides 54, 56 adjacent to the air/ink exchange port 32 on the base 14. Longitudinal air flow-restricting member 52 extends generally outwardly from the wall 22 and from the air/ink exchange port 32 a predetermined distance into the absorbing chamber 26.

In alternate embodiment(s), the air path(s) 46 may also be constricted by disposing a transverse air flow-restricting member 60 abutting/adjacent one of the two opposed sides 54, 56 of the longitudinal air flow-restricting member 52.

It is to be understood that the longitudinal air flow-restricting member(s) 52 may be of any suitable size, shape and/or configuration, may be formed from any suitable material, and may be disposed in any suitable location sufficient to desirably constrict/restrict longitudinal air flow as described herein.

Figure 7:
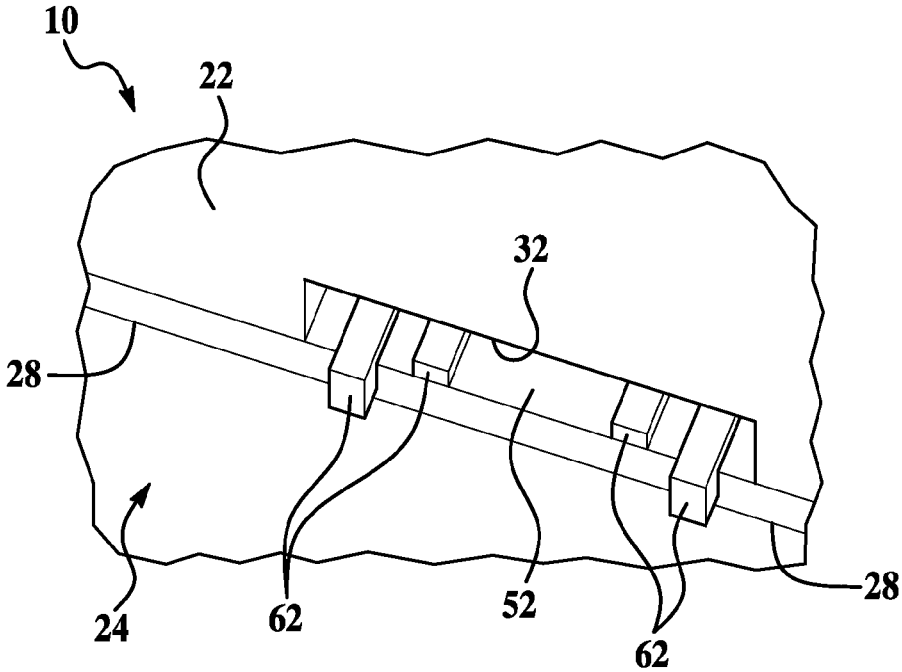
FIG. 7 is a further enlarged, cutaway, perspective view of the embodiment of the fluid cartridge of FIG. 6.

Referring still to FIG. 1, in an embodiment, the longitudinal air flow-restricting member 52 is generally a threshold such as a pad, a step, or other similar raised feature that is disposed within the absorber chamber 26 between the base 14 and the absorber 40, 40*a* (shown in FIGS. 3A and 3B) and is disposed in the air/ink exchange port 32. In an embodiment, the longitudinal air flow-restricting member 52 extends through the air/ink exchange port 32, and ends substantially flush with the plane of the face of wall 22 facing cavity 24 (as best seen in FIG. 7).

It is contemplated as being within the purview of the present disclosure that the longitudinal air flow-restricting member 52 be attached to the cartridge 10 by any suitable manner, be of any suitable thickness, and be of any suitable width.

In an embodiment, the member 52 is integrally molded with housing 12. The thickness of the member 52 may generally be less than about 2 mm, which thickness advantageously creates local compression of the adjacent absorber 40, 40*a*. The member 52 is generally as wide as the air/ink exchange port 32; however, it may, in some instances, be beneficial for the member 52 to be wider (as shown in phantom in FIG. 6) than the port 32. In an embodiment, member 52 is about 3 mm wider, on each side, than the port 32. It is believed that, in some implementations, such a wider threshold 52 may result in more uniform capillary media in the air/ink exchange port 32.

In general, the thickness of the member 52 is relatively small, but sufficiently thick enough to compress the capillaries of the absorber 40, 40*a* when the member 52 is disposed and installed in the cartridge 10. This results in reduced pore sizes/local compression of the capillaries of the absorber 40, 40*a* located adjacent to the member 52. Without being bound to any theory, it is believed that this reduced pore size may generate a relatively high capillary force, e.g., about 8" WC, thereby keeping the capillary pores filled with ink, and substantially preventing air traveling from between the base 14 and the absorber 40, 40*a* from reaching the air/ink exchange port 32.

As with the longitudinal air flow-restricting member 52, it is to be understood that the transverse air flow-restricting member(s) 60 (if included) may be of any suitable size, shape and/or configuration, may be formed from any suitable material, and may be disposed in any suitable location sufficient to desirably constrict/restrict transverse air flow as described herein.

In an embodiment, one transverse air flow-restricting member 60 is disposed in the absorbing chamber 26 adjacent to the wall 22 and to the side 54 of the longitudinal air flow-restricting member 52. If desired, a second member 60 (substantially identical to, and the mirror image of the one member 60) may be disposed on the other side 56 of the longitudinal air flow-restricting member 52. In an embodiment, the member(s) 60 are substantially triangularly-shaped inserts (e.g., gussets), substantially rectangularly-shaped inserts, substantially quarter circle/pie wedge-shaped inserts, and combinations thereof. The member(s) 60 may be positioned substantially orthogonally with respect to the side 36 of the wall 22 facing the second chamber 26 and substantially parallel with respect to the air/ink exchange port 32, thereby restricting or otherwise constricting air flow via the transverse air flow path(s) 46 and into the port 32.

Figure 6:
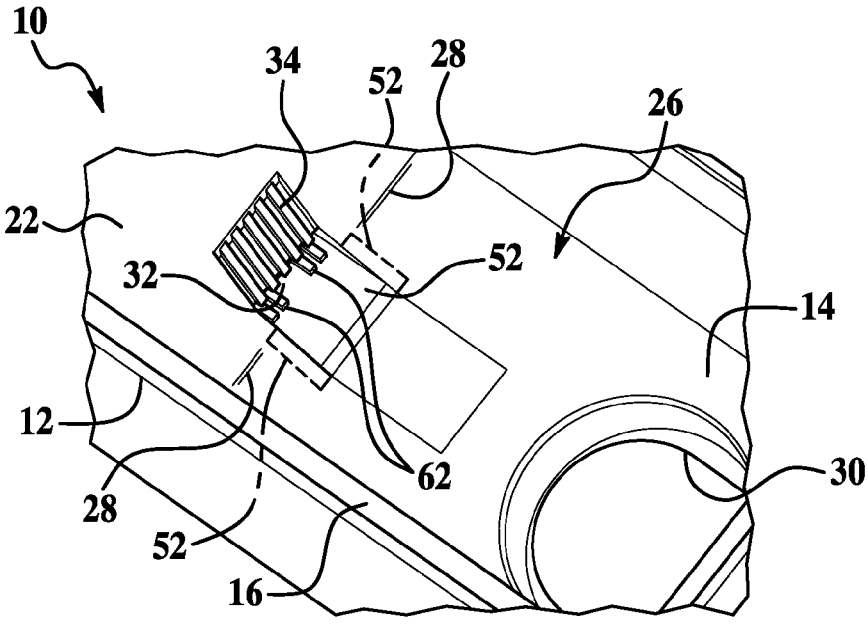
FIG. 6 is an enlarged, cutaway, perspective view of another embodiment of the fluid cartridge.

Referring now to FIGS. 6 and 7, this embodiment does not include a transverse air flow-restricting member 60. In this embodiment, as well as in any of the embodiments disclosed herein, the fluid cartridge 10 may further include one or a plurality of ribs 62 formed on/in the base 14, on/in the longitudinal air flow-restricting member 52, or on/in combinations thereof. Without being bound to any theory, it is believed that the ribs 62 form capillary paths to facilitate or otherwise promote fluid flow of ink between the free ink chamber 24 and the absorbing chamber 26 when air is flowing through, or remains stationary in the air/ink exchange port 32. In an embodiment (as best seen in FIG. 6), the ribs 62 are formed on/in the threshold 52 that extends proud of the face of wall 22 into chamber 26. As best seen in FIG. 7, in an embodiment, the ribs 62 may further extend on the threshold 52 through the air/ink exchange port 32 and partially into the FIC 24.

It is desirable that the edges formed at the base of the ribs 62 be relatively sharp and not substantially curved, as it is believed that bubbles have difficulty conforming to sharp corners. It is to be understood that the ribs 62 may be of any suitable size, however, in an embodiment, the ribs 62 may be from about 0.2 mm to about 0.6 mm wide; and from about 0.2 mm to about 0.6 mm high. In an embodiment, the ribs 62 are about 0.4 mm wide and about 0.4 mm high. The space between the ribs 62 may range from about 0.2 mm to about 0.6 mm. In an embodiment, the space between ribs is about 0.4 mm.

The ribs 62 also may function to substantially prevent air traveling through the air/ink exchange port 32 from breaking the fluid connection between the absorber 40, 40*a* and the free ink chamber 24. For example, when air is rapidly taken into the FIC 24, it can suddenly reduce the vacuum in the FIC 24 and disconnect the fluid in the FIC 24 from the absorber/HCM 40, 40*a*. When this happens, the ink in the FIC 24 is stranded because the absorber 40, 40*a* cannot pull it into the absorber 40, 40*a*. However, with the ribs 62, it is believed that capillaries are maintained that allow the absorber 40, 40*a* to pull ink in from the FIC 24. This ink pulled in from the FIC 24 gradually increases the vacuum in the FIC 24, which creates a pressure differential to pull more air into the FIC 24. As more air is pulled into the air/ink exchange port 32, any bubbles occluding the port 32 are substantially dislodged and float up into the FIC 24, thereby restoring proper function. Further, although a single rib 62 may function suitably in some instances, it is believed that additional ribs 62 may advantageously reduce the possibility that all the potential capillary paths along the edges between the threshold 52 and the ribs 62 are blocked by air bubbles.

In an embodiment, the fluid chamber may be formed by providing the housing 12 including the base 14, the free ink chamber 24, and the absorbing chamber 26. The wall 22, including the air/ink exchange port 32 defined in the bottom portion thereof, is disposed in the housing that extends outwardly from and substantially normal to the base 14, thereby separating the free ink chamber 24 and the absorbing chamber 26. The longitudinal air flow-restricting member 52 is disposed in the absorbing chamber 26, adjacent to the air/ink exchange port 32 and extending outwardly therefrom at a predetermined distance. The absorber 40, 40*a* may then be placed inside the absorbing chamber 26 and against the member 52 such that capillary edges of the absorber 40 are compressed, thereby restricting undesirable air flow therethrough from longitudinal air flow path 44.

If the transverse air flow-restricting member(s) 60 are utilized in an embodiment(s), they may be disposed in the absorbing chamber 26, respectively adjacent to the sides 54, 56 of the member 52, and adjacent to the air/ink exchange port 32. This may be accomplished by any suitable method, however, in an embodiment, the transverse air flow-restricting members 60 are molded into the housing 12, and insertion of the absorber 40, 40*a* causes members 60 to pierce the capillary or porous medium of the absorber 40, 40*a* substantially without distorting the capillaries. The member(s) 60 are thereby formed inside the chamber 26, adjacent to the air/ink exchange port 32, and substantially restrict undesirable air flow from the transverse air flow path(s) 46. If desired, the second absorber 40*b* (formed from, e.g., a low capillary media) may then be placed in contact with, and in fluid communication with the first absorber 40*a* (formed from, e.g. a high capillary media) before the cover 18 is secured to the housing 12.

Also disclosed herein is a method of restricting air flow to the air/ink exchange port 32 in the fluid cartridge 10. An embodiment of the method includes providing the fluid cartridge 10 including the housing 12, base 14, and the first and second chambers 24, 26, as described above. Wall 22 extends outwardly from and substantially normal to the base 14 and is configured to separate the housing 12, thereby forming the first and second chambers 24, 26. An air/ink exchange port 32 is defined in a bottom portion of the wall 22 and adjacent to the base 14. The method further includes restricting longitudinal air flow. The method may in some embodiment(s) also include restricting transverse air flow. In a further alternate embodiment, the method also may include promoting fluid flow between the first and second chambers 24, 26.

The present disclosure provides many advantages, some of which include the following. The air flow-restricting members 52, 60 may advantageously substantially constrict/restrict undesirable air flow from, e.g., air paths 44, 46. Without being bound to any theory, it is believed that restricting the air flow from the air paths 44, 46 by, e.g., operatively placing/forming members 52, 60 allows the back pressure in the cartridge 10 to be desirably regulated between the free ink chamber 24 and the absorber chamber 26. This may substantially prevent leaking through the nozzles. Members 52, 60 may also permit simpler construction of the absorbers 40, 40*a*, 40*b*. For example, in order to prevent additional undesirable air flow through the air/ink exchange port 32 from various air paths (non-limiting examples of which are defined herein), the absorbers 40, 40*a*, 40*b* may require very specific sizing and cutting, as well as very intricate installation procedures, in order to prevent these potential air paths from forming. Members 52, 60 may advantageously obviate this need for precision in fabrication and installation of absorbers 40, 40*a*, 40*b*.

While several embodiments have been described in detail, it will be apparent to those skilled in the art that the disclosed embodiments may be modified. Therefore, the foregoing description is to be considered exemplary rather than limiting.

What is claimed is:

1. A fluid cartridge for a printing device, comprising:

a housing including a base and a first and second chamber;

a wall extending outwardly from and substantially normal to the base, the wall configured to separate the housing, thereby forming the first and second chambers;

an air/ink exchange port defined in a bottom portion of the wall and adjacent to the base, the air/ink exchange port facilitating movement of air and ink between the first and second chambers;

a longitudinal air flow-restricting member disposed adjacent the air/ink exchange port and on the base, the longitudinal air flow-restricting member having two opposed sides aligned with the air/ink exchange port and extending outwardly a predetermined distance into one of the first or second chambers, wherein the one of the first or second chambers includes:

at least one capillary medium; and an ink outlet;

wherein the longitudinal air flow-restricting member extends from the wall configured to separate the housing toward the ink outlet; and at least one transverse air flow-restricting member, not in contact with a side wall of the housing, abutting at least one of the two opposed longitudinal air flow-restricting member sides, and positioned substantially parallel with respect to the air/ink exchange port.

2. The fluid cartridge as defined in claim 1 wherein the longitudinal air flow-restricting member is a threshold.

3. The fluid cartridge as defined in claim 1 wherein the at least one transverse air flow-restricting member is a triangularly-shaped insert, rectangularly-shaped insert, pie wedge-shaped insert, and combinations thereof.

4. The fluid cartridge as defined in claim 1 wherein the at least one transverse air flow-restricting members is configured to constrict an air path formed between the air/ink exchange port and an edge defined by the base and the wall.

5. The fluid cartridge as defined in claim 1 wherein the longitudinal air flow-restricting threshold is configured to constrict an air path formed between the ink outlet and the air/ink exchange port.

6. The fluid cartridge as defined in claim 1 wherein the first chamber is in fluid communication with the second chamber.

7. The fluid cartridge as defined in claim 6, further comprising a plurality of ribs formed on: the base; the longitudinal air flow-restricting member; or a combination thereof, wherein the plurality of ribs is configured to substantially promote fluid flow between the first and second chambers when air flows through, or remains stationary in the air/ink exchange port.

8. A fluid supply system for a printing device, comprising:
a fluid cartridge, including:
a housing including a base and a first and second chamber;
a wall extending outwardly from and substantially normal to the base, the wall configured to separate the housing, thereby forming the first and second chambers;
an air/ink exchange port defined in a bottom portion of the wall and adjacent to the base, the air/ink exchange port facilitating movement of air and ink between the first and second chambers;
a longitudinal air flow-restricting member disposed adjacent the air/ink exchange port and on the base, the longitudinal air flow-restricting member extending outwardly a predetermined distance into one of the first or second chambers, and the longitudinal air flow-restricting member having first and second opposed sides aligned with the air/ink exchange port, wherein the one of the first or second chambers includes:
at least one capillary medium; and
an ink outlet;
wherein the longitudinal air flow-restricting member extends from the wall configured to separate the housing toward the ink outlet; and
at least one transverse air flow-restricting member, not in contact with a side wall of the housing, abutting at least one of the first and second opposed longitudinal air flow-restricting member sides, and positioned substantially parallel with respect to the air/ink exchange port; and
a printhead fluidly connected to the fluid cartridge.

9. The fluid supply system as defined in claim 8 wherein the longitudinal air flow-restricting member is a threshold.

10. The fluid supply system as defined in claim 8 wherein an other of the first or second chambers includes a predetermined volume of liquid ink, and wherein the first chamber is in fluid communication with the second chamber.

11. The fluid supply system as defined in claim 10 wherein the ink outlet is formed in the base to allow fluid flow between the fluid cartridge and the printhead.

12. The fluid supply system as defined in claim 10 wherein the fluid cartridge further includes a plurality of ribs formed on: the base; the longitudinal air flow-restricting member; or a combination thereof, and wherein the plurality of ribs is configured to substantially promote fluid flow between the first and second chambers.

13. The fluid supply system as defined in claim 8
wherein the at least one transverse air flow-restricting member is configured to constrict an air path formed between the air/ink exchange port and an edge defined by the base and the wall.

14. A method of restricting air flow to an air/ink exchange port in a fluid cartridge, the method comprising:
providing a fluid cartridge, including:
a housing including a base and a first and second chamber;
a wall extending outwardly from and substantially normal to the base, the wall configured to separate the housing, thereby forming the first and second chambers; and
an air/ink exchange port defined in a bottom portion of the wall and adjacent to the base, the air/ink exchange port facilitating movement of air and ink between the first and second chambers;
a longitudinal air flow-restricting member disposed adjacent the air/ink exchange port and on the base, the longitudinal air flow-restricting member having two opposed sides aligned with the air/ink exchange port and extending outwardly a predetermined distance into one of the first or second chambers, wherein the one of the first or second chambers includes:
at least one capillary medium; and
an ink outlet;
wherein the longitudinal air flow-restricting member extends from the wall configured to separate the housing toward the ink outlet; and
at least one transverse air flow-restricting member, not in contact with a side wall of the housing, abutting at least one of the two opposed longitudinal air flow-restricting member sides, and positioned substantially parallel with respect to the air/ink exchange port;
wherein air flow from at least one air path to the air/ink exchange port is restricted.

15. The method as defined in claim 14, further comprising a plurality of ribs formed on: the base; the longitudinal air flow-restricting member; or a combination thereof, wherein the plurality of ribs is configured to promote fluid flow between the first and second chambers.

16. The method as defined in claim 14 wherein the at least one air path is formed between the air/ink exchange port and an edge defined by the base and the wall.

17. The method as defined in claim 14, wherein the ink outlet is configured to be in fluid communication with a printhead.

18. The method as defined in claim 17 wherein the at least one air path is formed between the ink outlet and the air/ink exchange port.

* * * * *

UNITED STATES PATENT AND TRADEMARK OFFICE

CERTIFICATE OF CORRECTION

PATENT NO. : 8,066,360 B2
APPLICATION NO. : 11/736750
DATED : November 29, 2011
INVENTOR(S) : John A. Myers et al.

It is certified that error appears in the above-identified patent and that said Letters Patent is hereby corrected as shown below:

Title page, Item (57), Abstract, in column 2, line 9, delete "predetermined" and insert -- a predetermined --, therefor.

In column 10, line 49, in Claim 17, delete "claim 14," and insert -- claim 14 --, therefor.

Signed and Sealed this
Sixteenth Day of October, 2012

David J. Kappos

David J. Kappos
*Director of the United States Patent and Trademark Office*